US005816487A

United States Patent [19]

Skinner

[11] Patent Number: 5,816,487

[45] Date of Patent: Oct. 6, 1998

[54] GABLE TOP CARTON

[75] Inventor: Edward Albert Skinner, Welwyn Garden City, United Kingdom

[73] Assignee: Elopak Systems AG, Glattbrugg, Switzerland

[21] Appl. No.: 737,199

[22] PCT Filed: May 5, 1995

[86] PCT No.: PCT/IB95/00324

§ 371 Date: Nov. 7, 1996

§ 102(e) Date: Nov. 7, 1996

[87] PCT Pub. No.: WO95/30583

PCT Pub. Date: Nov. 16, 1995

[30] Foreign Application Priority Data

May 9, 1994 [GB] United Kingdom ..... 94091592

[51] Int. Cl.[6] ..... B65D 5/70

[52] U.S. Cl. ..... 229/248; 229/125.82; 229/208; 229/213; 229/24

[58] Field of Search ..... 229/125, 42, 137, 229/208, 209, 213, 248, 249

[56] References Cited

U.S. PATENT DOCUMENTS 2,695,745 11/1954 Dixon ..... 229/249
4,124,159 11/1978 Schwarzkopf ..... 229/248
4,190,190 2/1980 Halonen ..... 229/137
4,211,357 7/1980 Lisiecki ..... 229/248
4,390,121 6/1983 Lisiecki ..... 229/249
4,582,246 4/1986 Lisiecki ..... 229/248
4,813,546 3/1989 Gordon et al. ..... 229/125.42
5,176,308 1/1993 Frazier ..... 229/249

*Primary Examiner*—Gary E. Elkins
*Attorney, Agent, or Firm*—Reising, Ethington, Learman & McCulloch PLLC

[57] ABSTRACT

A gable-top carton has at least half, if not all, of its spout-forming, folded-in, top sealing panels (33) projecting above an adjacent non-folded-in top sealing panel (32) to permit a user to grasp that projection and pull it forward to open the spout. To provide a flattened gable-top carton, the other non-folded-in top sealing panel (34) may be extended to be tacked down onto an opposite top obturating panel (22) and be formed with a tear strip to facilitate detachment of the turned-down sealing fin (32–35) from the tacked-down part of that other non-folded-in top sealing panel (34) and to cover a pouring edge zone of the adjacent half of the spout-forming, top sealing panel (33). The carton can be made from an appropriately shaped and scored blank.

10 Claims, 10 Drawing Sheets

GABLE TOP CARTON

Figure 1:
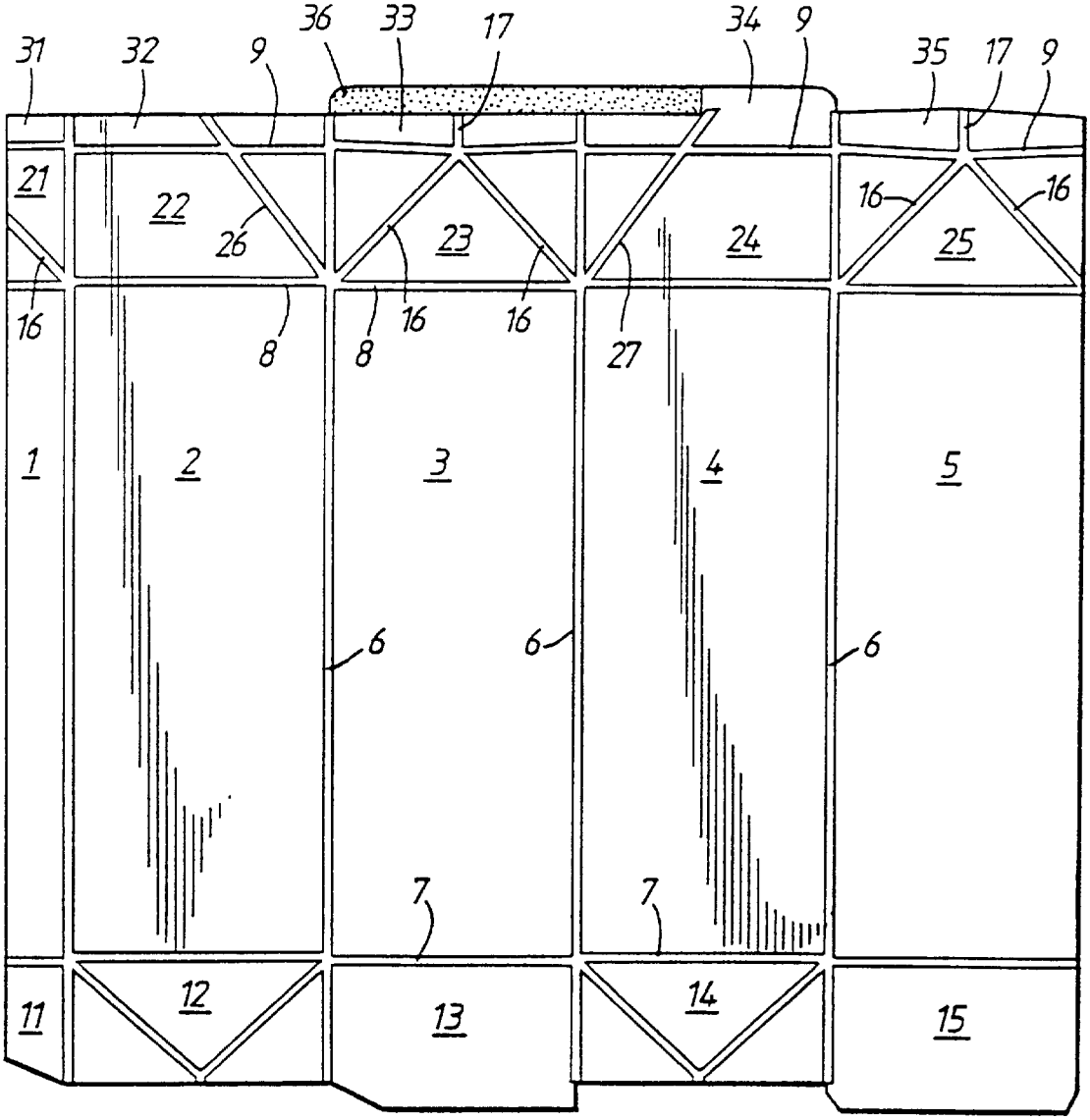

This invention relates to a carton and a blank from which the carton can be made.

Conventional gable-top and flattened gable-top cartons can be made from blanks each consisting of a laminate. The laminate comprises paperboard coated on both faces with thermoplastics, for example low density polyethylene (LDPE), possibly with the interposition of an oxygen barrier layer, for example aluminium or ethylene vinyl alcohol (EVOH). Score lines divide each blank into a row of four body panels, a row of four bottom closure panels of which two alternate panels are formed with oblique score lines to form three triangular sub-panels, a row of four top closure obturating panels of which two alternate panels are formed with oblique score lines to form three triangular sub-panels, a row of four top closure sealing panels of which two alternate panels are divided into halves by respective score lines, and a side seam flap at one edge of the blank. To form a carton, the panels are folded about score lines perpendicular to the rows and the side seam flap is heat-and pressure-sealed to the panels at the opposite edge of the blank, thus to form a sleeve open at both ends. The bottom closure panels are folded inwards, with the two alternate panels preceding the other two panels, and heat-and pressure-sealed to each other to close the carton bottom. The carton is filled and then the top closure panels are folded inwards, with the two alternate obturating panels preceding the other two obturating panels, and the sealing panels being heat-and pressure-sealed to each other, with the two alternate sealing panels being disposed between the other two sealing panels, to form a sealing fin and thus close the carton top. It is known to coat parts of top sealing panels at one end of the sealing fin with abhesive to provide an openable pouring spout. In particular, it is known to coat with abhesive the inside and the outside edge zones of the free edge of that centrally folded sealing panel at that one end of the sealing fin, which free edge constitutes a pouring lip for the spout.

AU-B-626389 discloses a blank and a sealed carton of the character described above, but with the two folded-in top sealing panels of the carton having their free edges at a level below that of the free edges of the two other top sealing panels, except for a tab which is spaced from both the central portion and an adjacent outer end portion of the spout-providing, folded-in top sealing panel and which extends upwardly to a position above the level of the free edges of those two other top sealing panels, to be grasped and pulled by a user to enable the spout-providing, top sealing panel to be separated from those two other top sealing panels without any contact by the user with the inner surface of the spout-providing top sealing panel. The tab is spaced from the central portion of the spout a distance sufficient that, during normal use, no part of the contents of the container will contact the tab during pouring. There is a serious risk with this tab that, when pulled, it will tear away downwards, delaminating that relatively narrow part of the spout-providing top sealing panel immediately therebelow, so that the top closure remains closed.

U.S. Pat. No. 5,014,854 discloses a blank and a sealed carton of the same general character, but with the carton of a flattened gable-top form in which, after top sealing, the sealing fin is turned down onto one of the two roof-forming top obturating panels and the top closure flattened downwards. That one of the two non-folded-in top sealing panels which is uppermost after turning down of the sealing fin has an extension which projects beyond the other three top sealing panels and is tacked down to the top surface of the aforesaid one of the two roof-forming top obturating panels. The extension includes a tear strip defined by two arrays of perforations extending parallelly to the sealing fin and located between the sealing fin and the tacked-down part of the extension. The inwardly facing surface of the tear strip is coated with an anti-seal material to facilitate the separation of the tear strip from the top surface of the aforesaid one of the two roof-forming top obturating panels. Although the tear strip facilitates detachment of the sealing fin from the latter obturating panel, it does nothing towards facilitating opening of the sealing fin itself to bring out the spout.

According to one aspect of the present invention, there is provided a blank from which a carton is to be made, comprising a row of body panels comprised of first, second, third and fourth body panels with first lines of weakness thereamong, a row of top closure obturating panels comprised of first, second, third and fourth obturating panels with second lines of weakness thereamong and with third lines of weakness between the first, second, third and fourth obturating panels and the first, second, third and fourth body panels, respectively, and a row of top closure sealing panels comprised of first, second, third and fourth sealing panels with fourth lines of weakness thereamong and with fifth lines of weakness between the first, second, third and fourth sealing panels and the first, second, third and fourth obturating panels, respectively, sixth lines of weakness in the first obturating panel and the first sealing panel and seventh lines of weakness in the third obturating panel and the third sealing panel, whereby the first and third obturating panels may be folded to respective gable formations under the second and fourth obturating panels and whereby the first and third sealing panels may be centrally folded to between the second and fourth sealing panels to form a sealing fin and whereby the first obturating panel and the first sealing panel may be folded to form a pouring spout having as a pouring edge the free edge of said first sealing panel, a portion of that half of the first sealing panel nearer the second sealing panel projecting further from said row of obturating panels than does a portion of said second sealing panel, which two portions extend over equal distances relative to the boundary between the first and second sealing panels, characterized in that the projecting portion of said first sealing panel extends along substantially half at least of the length of said free edge of said first sealing panel and over the middle of said free edge of said first sealing panel.

According to a second aspect of the present invention, there is provided a sealed carton comprising a loop of body panels comprised of first, second, third and fourth body panels, a loop of top closure obturating panels comprised of first, second, third and fourth obturating panels connected to the first, second, third and fourth body panels, respectively, and a loop of top closure sealing panels forming a sealing fin and comprised of first, second, third and fourth sealing panels connected to the first, second, third and fourth obturating panels, respectively, the first obturating panel and the first sealing panel serving to form a pouring spout when the carton is opened, a terminal outer edge zone of said first sealing panel projecting beyond an adjacent terminal outer edge zone of said second sealing panel, characterized in that the projecting terminal outer edge zone of said first sealing panel extends along substantially half at least of the length of the terminal outer edge of said first sealing panel and over the middle of said terminal outer edge of said first sealing panel.

Owing to the present invention, it is possible to open out more easily a pouring spout constituted by part of the wall of a carton, because the user can grasp a projection of sufficient width to minimize the risk of tearing down the first sealing panel part directly beneath the projection, rather than opening of the spout, and the user can pull centrally of the first sealing panel rather than to one side thereof with the risk of distortion of the spout.

The projecting portion preferably extends over substantially the whole of that half of the pouring edge of the first sealing panel nearer the second sealing panel, but particularly over substantially the whole of the pouring edge of the first sealing panel to allow the user a good central pull.

It is particularly advantageous for the fourth sealing panel to project to at least the extent of the longitudinal pouring edge and for that fourth sealing panel to be folded down onto the opposite obturating panel of the top closure so as to protect the otherwise exposed inside pouring edge zone for sanitary reasons.

In order further to facilitate opening of the carton, it may be advantageous to add abhesive to those surfaces of the first sealing panel which come together face-to-face in the sealing fin.

It can also be advantageous to apply abhesive to the inside pouring edge zone of the first sealing panel, since this discourages tearing of the pouring lip during opening of the carton and thus helps to give the pour spout a tidy appearance.

If that fourth sealing panel projects beyond the pouring edge, it may incorporate a tear strip and have its outermost edge zone (which excludes the tear strip) sealed to the top of the carton. This facilitates freeing of the sealing fin to allow it to be turned away through approximately a right-angle from the top of the carton. The inside surface of the tear strip is preferably coated with abhesive, to facilitate separation of the tear strip from the panel surface(s) beneath it. The tear strip advantageously covers an inside pouring edge zone of that half of the first sealing panel nearer the tear strip.

Figure 2:
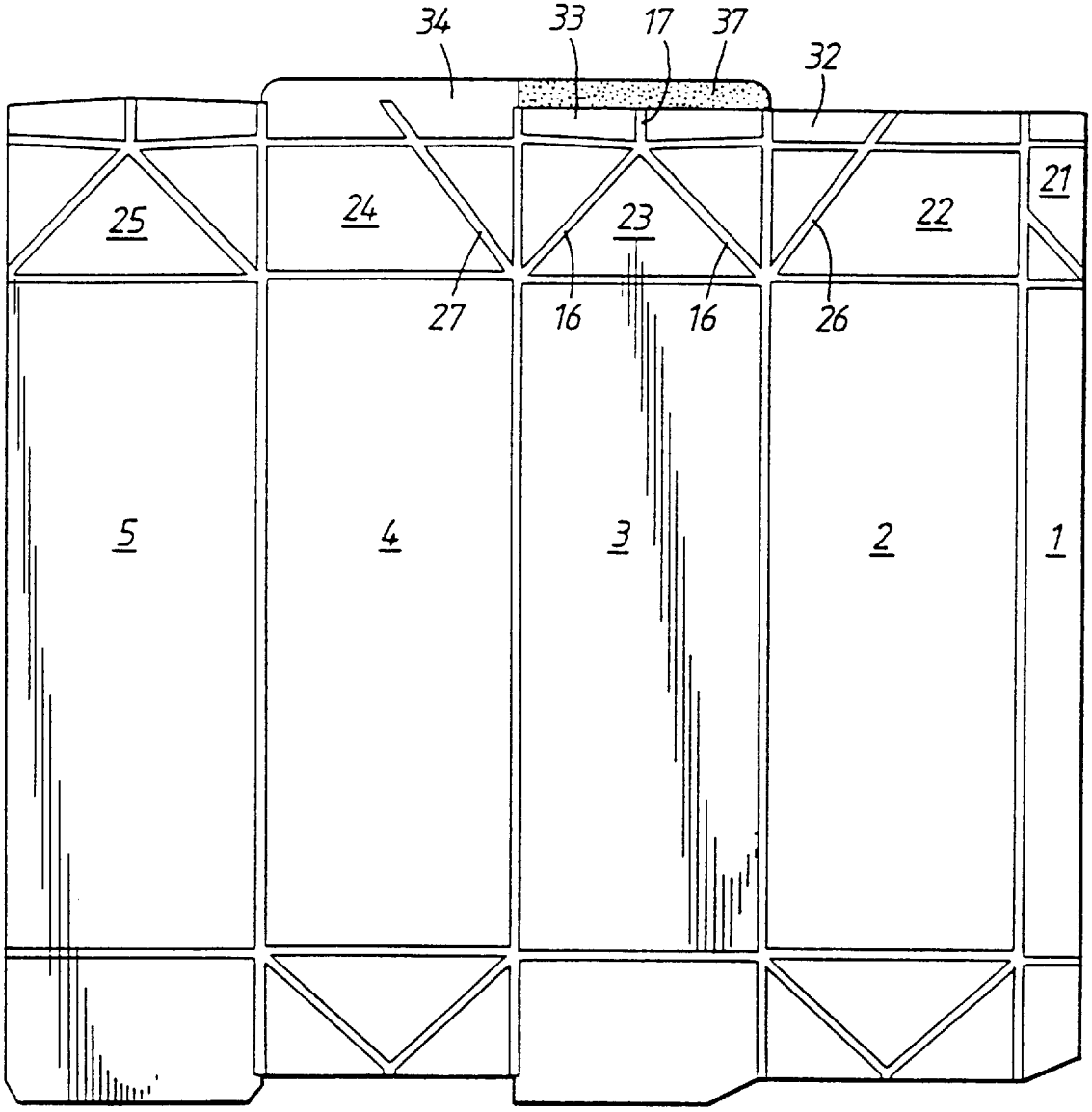
Figure 3:
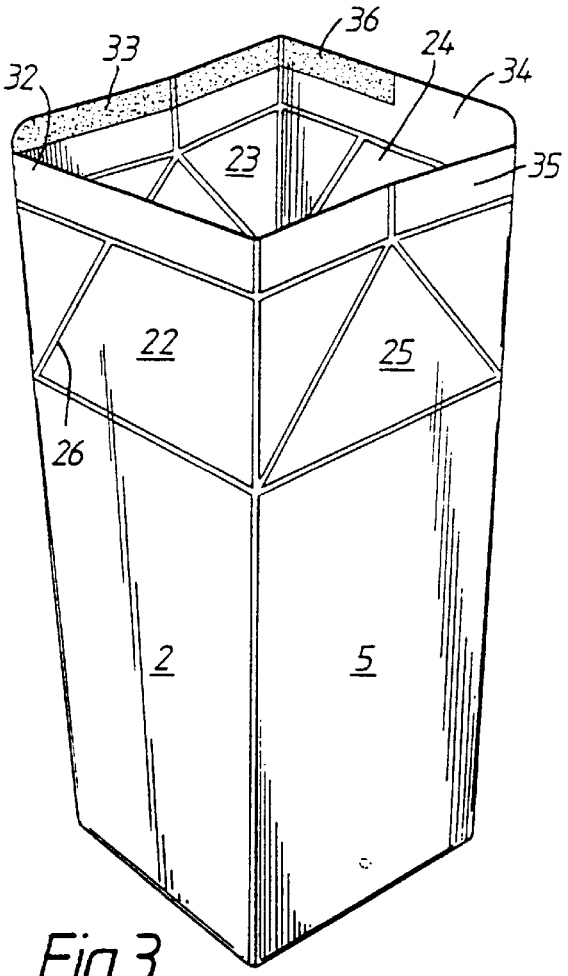
Figure 4:
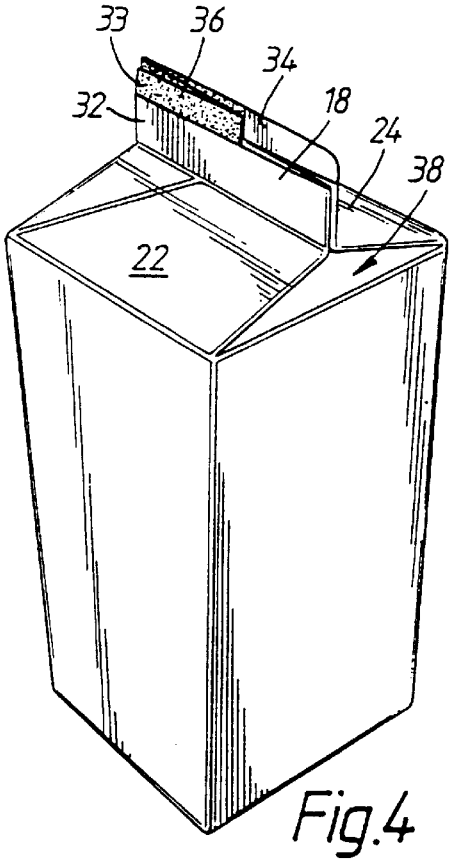
Figure 5:
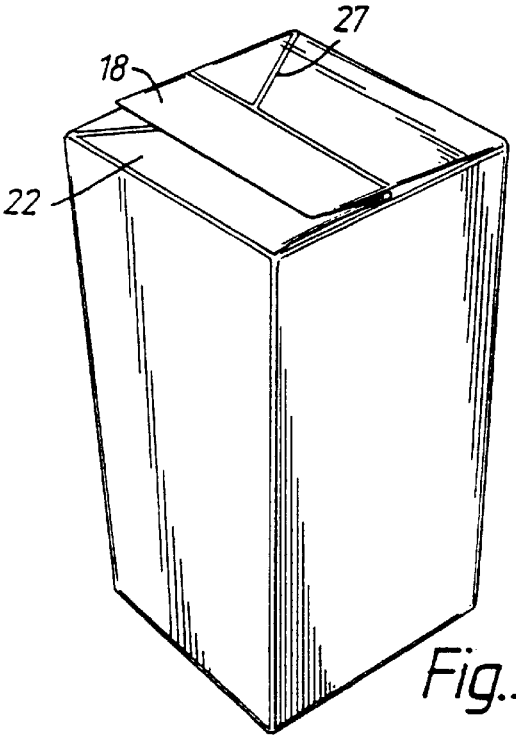
Figure 6:
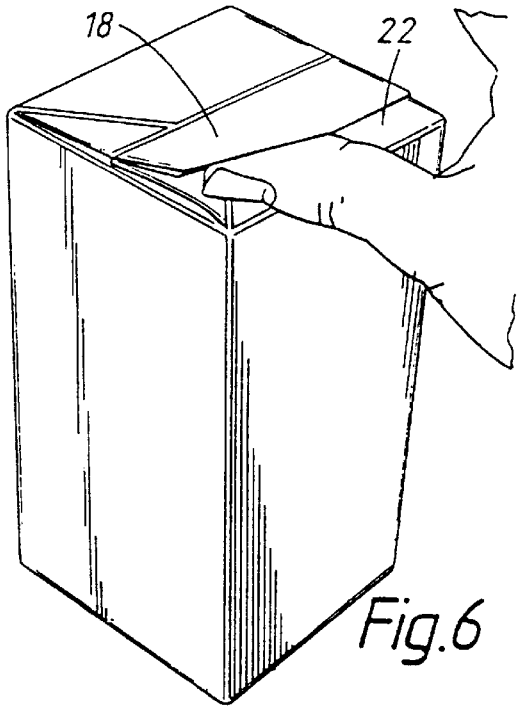
Figure 7:
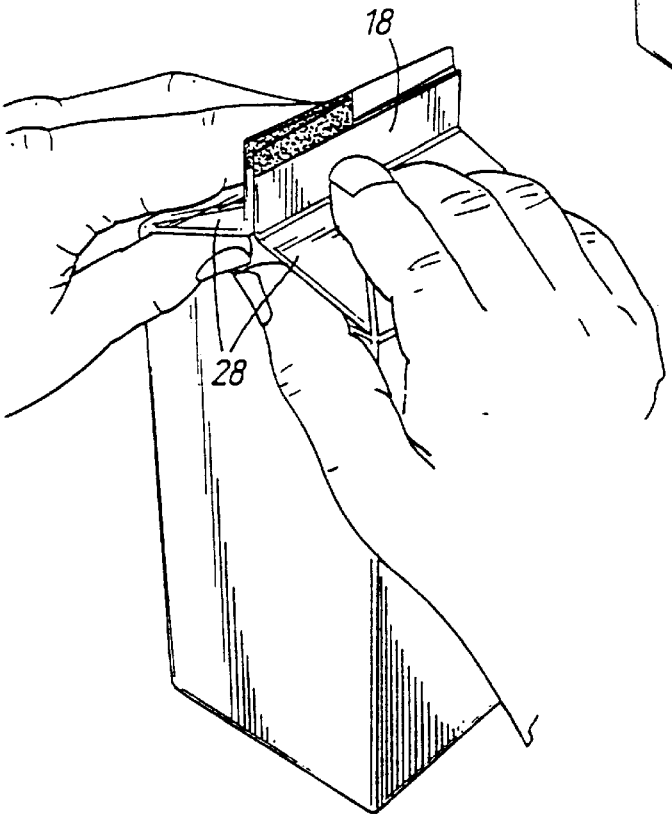
Figure 8:
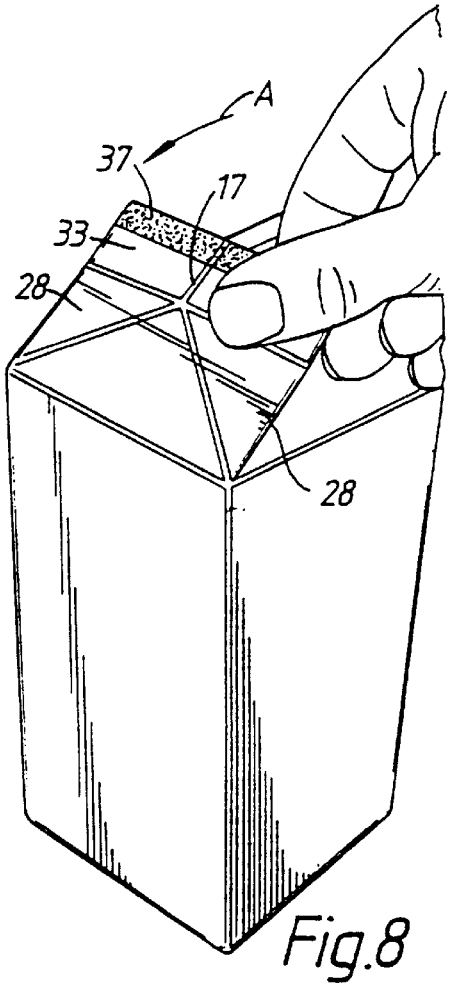
Figure 9:
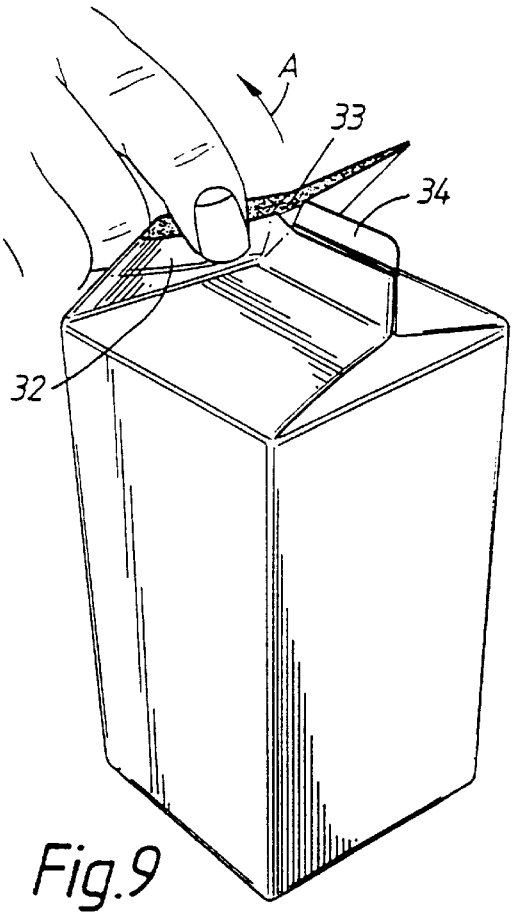
Figure 10:
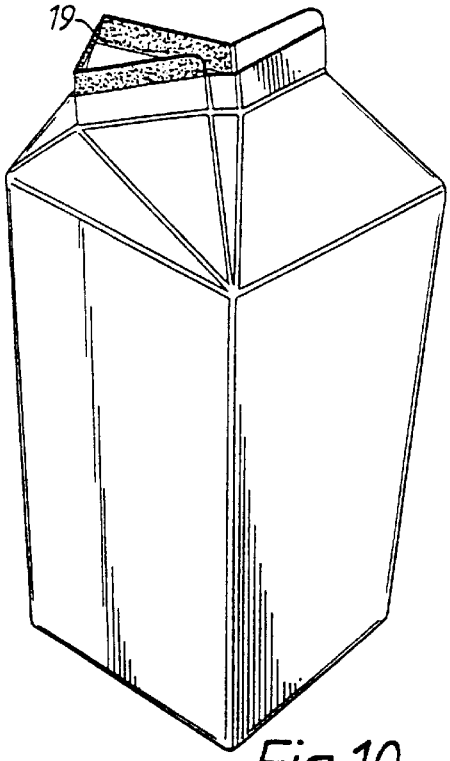
Figure 11:
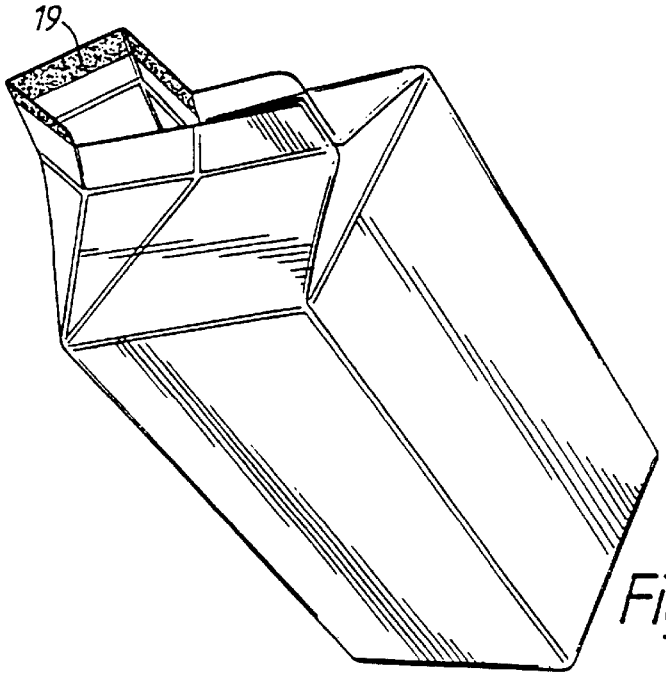
Figure 12:
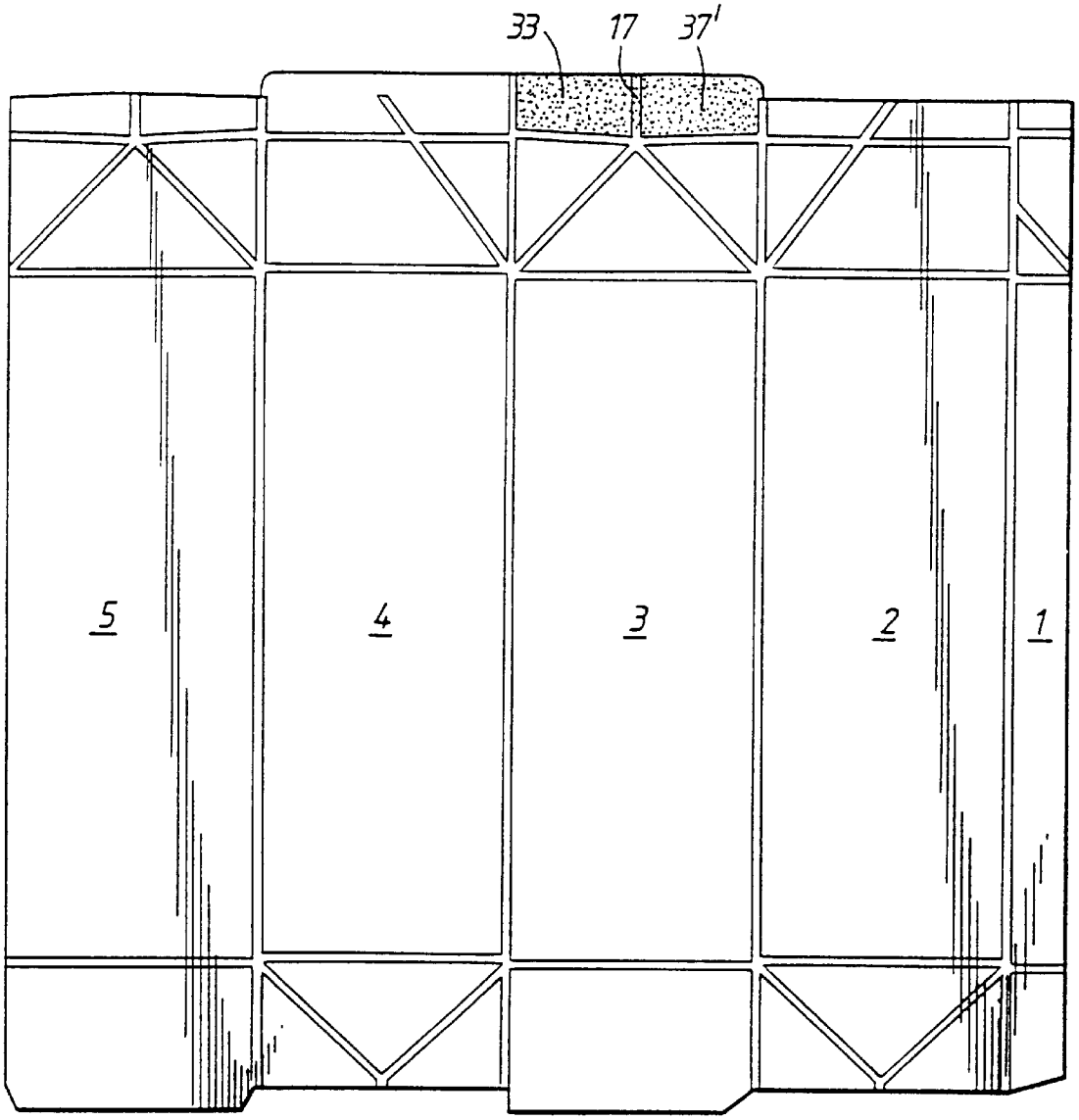
Figure 13:
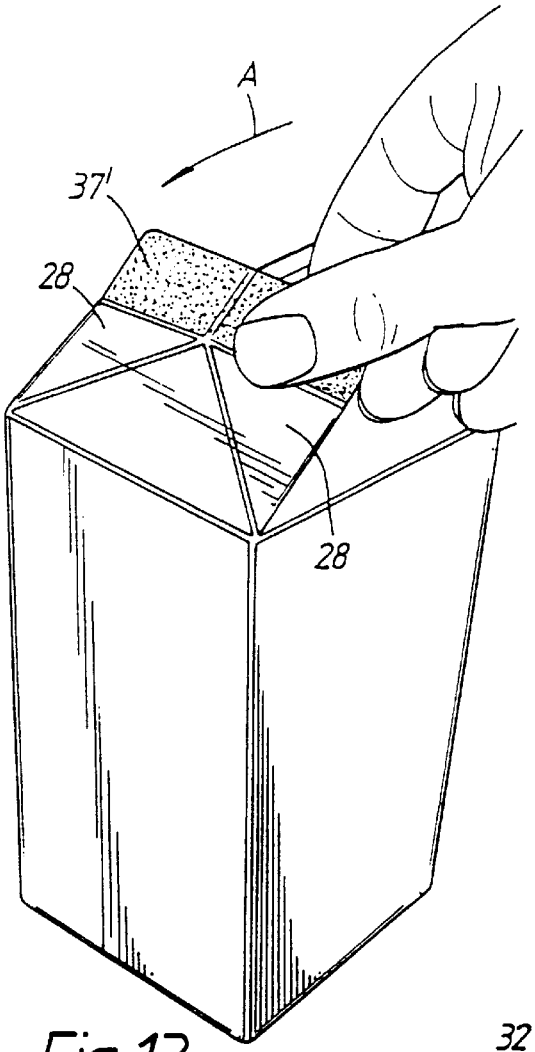
Figure 14:
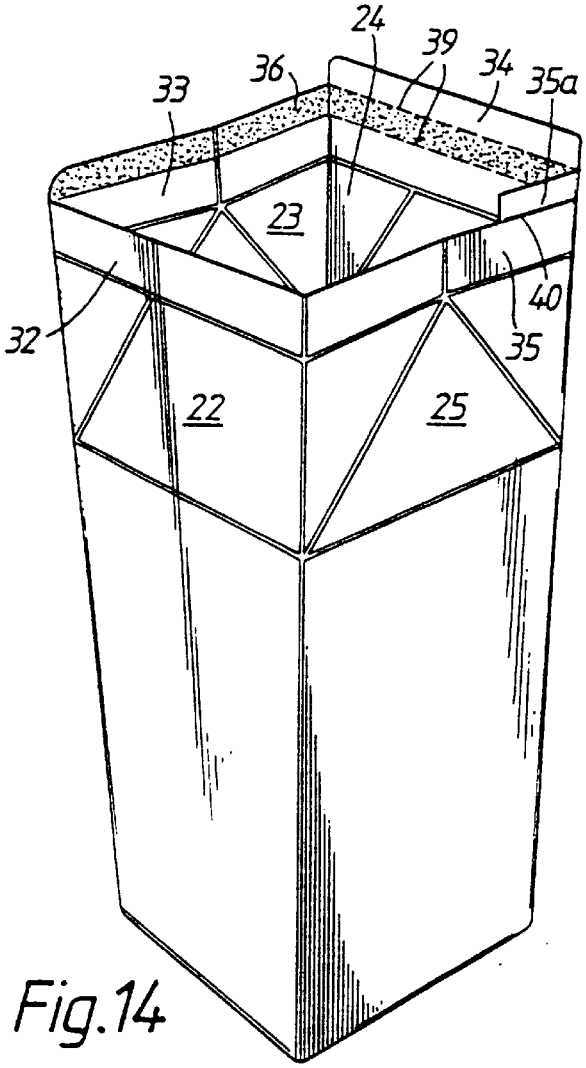

In order that the invention may be clearly understood and readily carried into effect, reference will now be made, by way of example, to the accompanying drawings, in which:

FIG. 1 is a plan view of that surface of a blank which is to form the inside surface of a carton, FIG. 2 is a plan view of that surface of the blank which is to form the outside surface of the carton, FIG. 3 is a perspective view from above of the carton after bottom-sealing but prior to filling, FIG. 4 is a view similar to FIG. 3, but of the carton after filling and top-sealing, FIG. 5 is a view similar to FIG. 3, but of the carton after tacking-down of a sealing fin thereof, FIG. 6 is a perspective view from above of the carton with its sealing fin being lifted from one end as a preliminary to opening of the carton, FIG. 7 is a view similar to FIG. 6, but showing the sealing fin totally raised and with wings of a gable formation of the carton about to be turned back, FIG. 8 is a view similar to FIG. 6 but with a pouring spout about to be pulled forwards, FIG. 9 is a view similar to FIG. 3, but corresponding to FIG. 8 in showing the pouring spout about to be pulled forwards, FIG. 10 is a view similar to FIG. 3, but showing the pouring spout fully opened, FIG. 11 is a view similar to FIG. 3, but showing the carton tilted ready for pouring, FIG. 12 is a view similar to FIG. 2, but of a modified version, FIG. 13 corresponds to FIG. 8, but shows the modified version, and FIGS. 14 to 21 substantially correspond to FIGS. 3 to 10, respectively, but illustrate another modified version.

Referring to FIGS. 1 and 2, the blank is a laminate which may consist of paperboard coated on both faces with a thermoplastic, particularly polyethylene. It includes a row of body panels 1 to 5, among which are parallel score lines 6. It also includes a row of bottom closure panels 11 to 15 among which are again the score lines 6. Between the panels 1 to 5 and the respective panels 11 to 15 are score lines 7. The blank further includes a row of top closure obturating panels 21 to 25 and a row of top closure sealing panels 31 to 35. Among the panels 21 to 25 and among the panels 31 to 35 are again the score lines 6. Between the obturating panels 21 to 25 and the respective body panels 1 to 5 are score lines 8, whilst between the sealing panels 31 to 35 and the respective obturating panels 21 to 25 are score lines 9. The panels 1, 11, 21 and 31 constitute a side seam flap. Each of the obturating panels 21, 23 and 25 are formed with score lines 16 whereby the panel 23 and the panel 21/25 can be folded to a gable formation. Each of the panels 33 and 35 is formed with a central score line 17 whereby it can be folded in half and brought to between the sealing panels 32 and 34 in the sealing fin 18. The score line 17 of the sealing panel 33 and the score lines 16 of the obturating panel 23 enable those panels to be folded outwards, during opening of the carton, to provide a pouring spout 19. An oblique score line 26 in the panels 22 and 32 and an oblique score line 27 in the panels 24 and 34 facilitate folding back of the wings 28 of the gable formation. It will be noted that the sealing panels 33 and 34 project away from the row of obturating panels 21 to 25 to the same extent as each other but to a significantly greater extent than do the sealing panels 31,32 and 35, all three of which project to substantially the same extent. The extent of such projection by the sealing panel 32 is between one-third and two-thirds, preferably about one-half, of the extent of such projection by the sealing panel 33. That area of the inside surface of the sealing panel 33 additionally projecting compared with the panel 32 has a strip-form coating 36 of abhesive which continues onto the inside surface of the sealing panel 34 up to the score line 27. As shown in FIG. 2, there is a corresponding strip-form coating 37 on the outside surface of the sealing panel 33, but it does not extend onto the outside surface of the sealing panel 34.

To form the carton from the blank shown in FIGS. 1 and 2, the side seam flap consisting of the panels 1, 11, 21 and 31 is heat-and pressure-sealed to the opposite edge of the blank and then subsequently the carton sleeve so formed is bottom-sealed to produce an open-topped carton as shown in FIG. 3. The carton is then filled with milk or orange juice, for example, and the panels 25 and 35, and also the panels 23 and 33 are then folded in, with the panels 22 and 24 being folded in over the panels 23 and 25, and the panels 32 and 34 being brought in to receive the centrally folded panels 33 and 35 between them. Then, the sealing panels 32 to 35 are heat-and pressure-sealed together to provide the sealing fin 18 shown in FIG. 4, with respective gable formations (of which one is indicated at 38) being produced below the respective ends of the fin 18. It will be noted from FIG. 4 that half of the additionally projecting area of the sealing panel 33 protrudes above the outer longitudinal edge of the sealing panel 32, the projecting half in question being coated with the abhesive 36. The sealing fin 18 is then turned down onto the panel 22 and heat-and pressure-tacked thereto, to provide the flat-topped carton shown in FIG. 5. The shielding of the additionally projecting area of the sealing panel 34 by the abhesive coating 36 seen on the panel 33 in FIG. 4 confines tacking-down of the panel 34 to only one-half of its additionally projecting zone.

The method of opening the carton will now be described with reference to FIGS. 6 to 11. Firstly, as shown in FIG. 6, a consumer may apply his thumb to beneath one end of the sealing fin 18 and run it along the fin, to break the tacking between the fin and the panel 22. The thumb will be able to penetrate more easily to beneath the end where the abhesive 36 is present than to beneath the other end, so the consumer should be instructed to commence at the abhesive end of the fin 18. The consumer brings the fin 18 into the vertical position shown in FIG. 7 and then turns the wings 28 back about the score lines 16 of the panel 23 and the score lines 26 and 27, while splitting the fin 18 along its middle to substantially the fold (17) in the sealing panel 33. This splitting is facilitated by the presence of the abhesive strip-like coating 37. The consumer then places his index finger behind that zone of the sealing panel 33 which projects above the sealing panel 32 and pulls the panel 33 forward, i.e. in the direction of the arrow A in FIGS. 8 and 9, to detach the panel 33 from the panels 32 and 34 and pull the pouring spout 19 into the fully open condition shown in FIGS. 10 and 11. Owing to the provision of the abhesive coatings 36 and 37, the pouring edge of the spout separates cleanly from the obturating panel 22 (owing to the coating 36), from itself (owing to the coating 37) and from the sealing panel 34 (owing to the coating 36).

In the version shown in FIGS. 12 and 13, the coating 37 has been extended to provide a coating 37' over the whole of the outside surface of the sealing panel 33, with the result that the wings 28 are even more readily turned back. Such extension of the abhesive coating on the outside of the sealing panel 33 does not reduce the integrity of the liquid-tight seal of the top closure, because, as will be understood from FIG. 3, the top closure relies for its liquid-tight sealing upon the seal among the inside surfaces of the sealing panels 32 and 35, half of the inside surface of the panel 34, the lower part of the other half of that inside surface, and the lower part of the inside surface of the sealing panel 33. Such sealing over only the area where there are four and five thicknesses of laminate provides a simple and effective seal.

Figure 15:
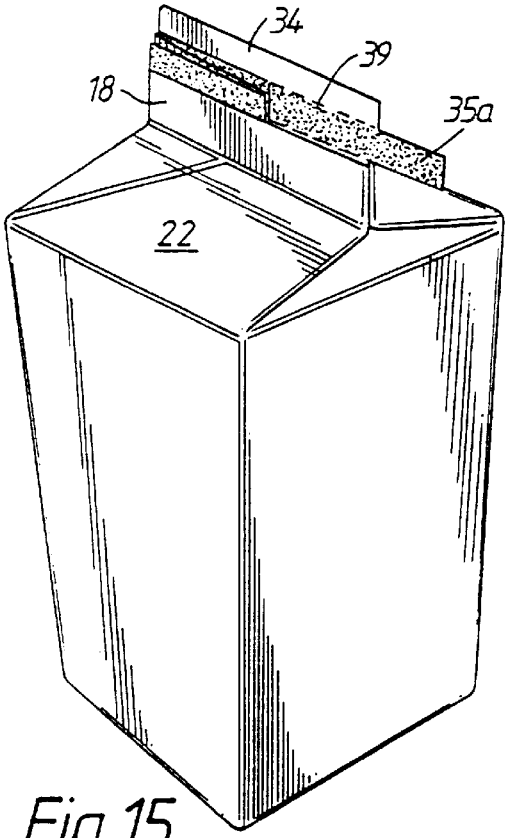
Figure 16:
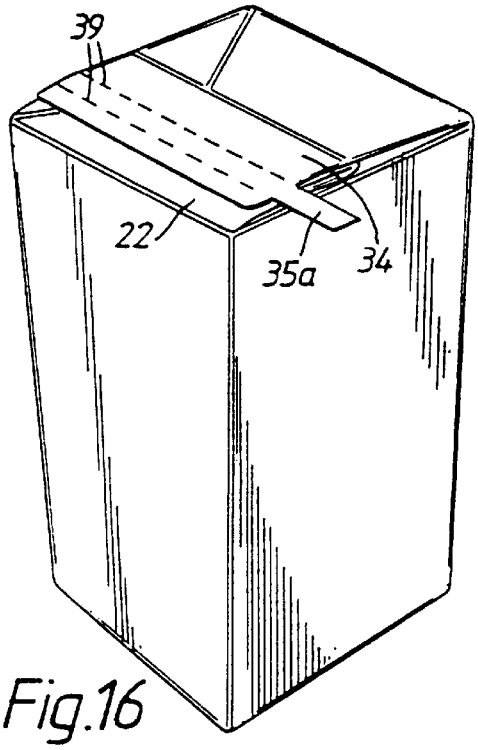
Figure 18:
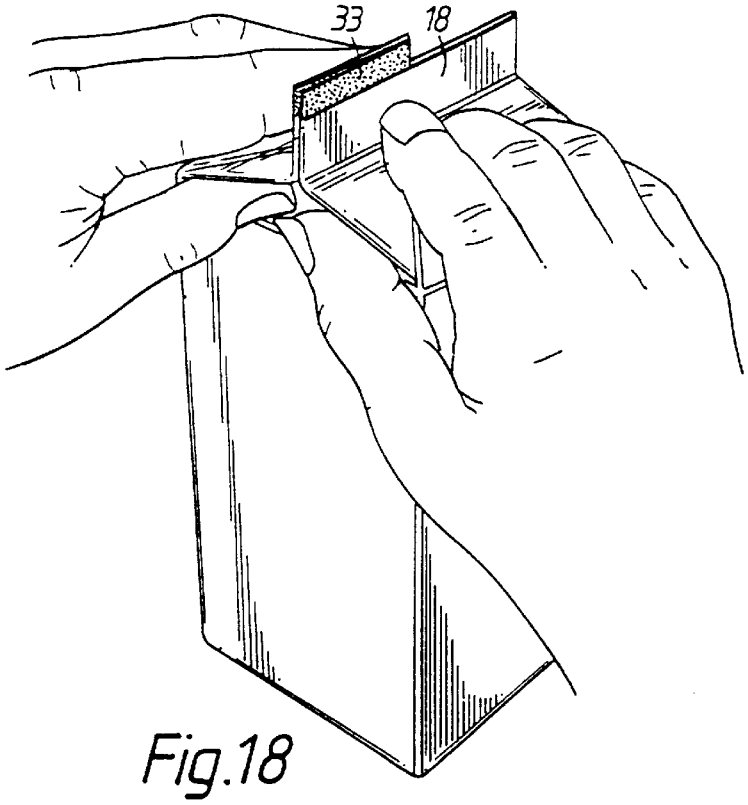

In the version shown in FIGS. 14 to 21, the sealing panel 34 projects even further from the loop of obturating panels 21 to 25 than does the sealing panel 33. Moreover, the sealing panel 35 has a rectangular portion 35*a* thereof which projects to the same extent as the sealing panel 33. The strip-form coating 36 of abhesive is further extended along the panel 34 and onto the inside surface of the whole of the portion 35*a*. Immediately above and below the coating 36 on the panel 34 are respective parallel lines of perforation 39 extending from one end to the other of the panel 34. The portion 35*a* is separated from the panel 35 by a cut 40, except at the inner end of the portion 35*a*, where it is weakly attached to the panel 35. Before forming of the sealing fin 18, the portion 35*a* is broken free from the panel 35 and forms a seizing tab for the tearstrip constituted by the portion of the panel 34 between the perforation lines 39, as indicated in FIG. 15. Then the fin 18 is turned down onto the panel 22 and that portion of the sealing panel 34 outwards of the outer perforation line 39 is heat-and pressure-tacked to the panel 22, as indicated in FIG. 16.

Figure 17:
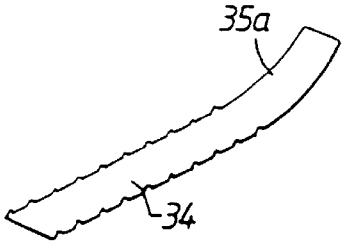
Figure 17:
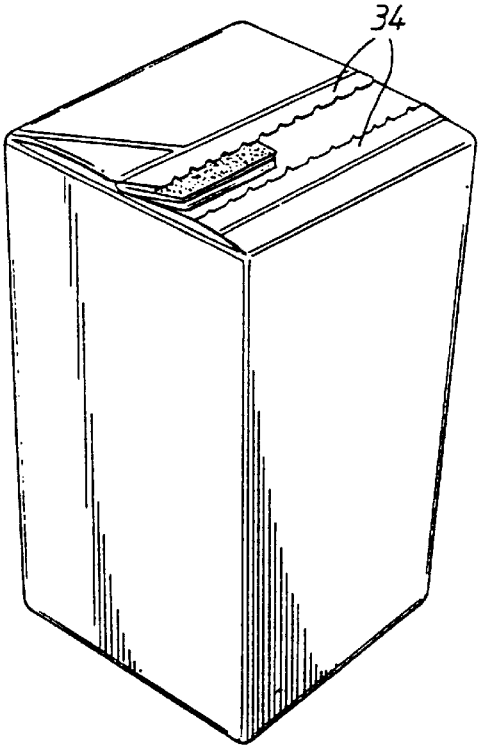
Figure 19:
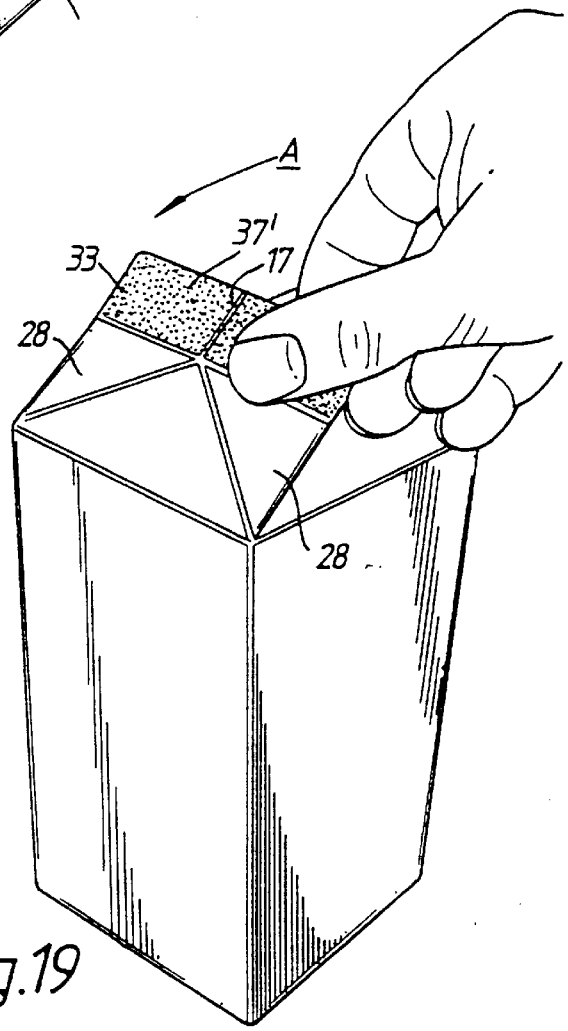
Figure 20:
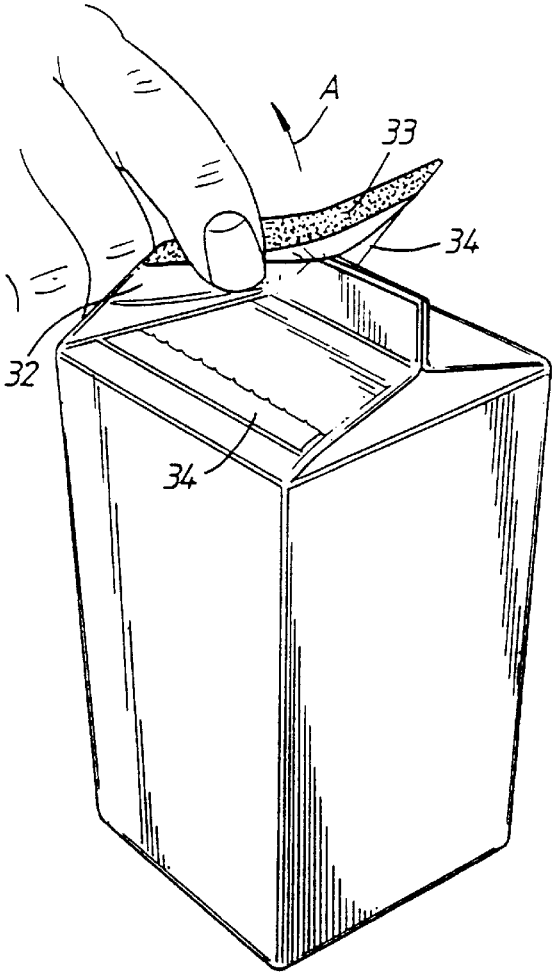
Figure 21:
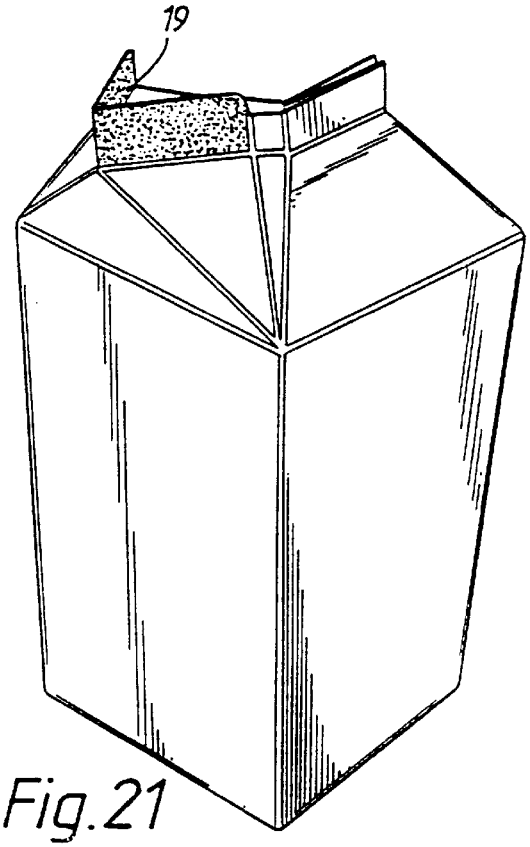

To open the carton thus formed, the tab 35*a* is pulled by the consumer to remove the tear strip, as shown in FIG. 17. The sealing fin 18 can then be raised into the vertical position shown in FIG. 18, from which it will be noted that both additionally projecting halves of the sealing panel 33 are revealed. The wings 28 can now be turned back and the consumer's index finger applied behind the projecting zone of the panel 33 and pulled in the direction of the arrow A to detach the panel 33 from the panels 32 and 34. Although the index finger can be applied unilaterally to the panel 33, as shown in FIGS. 19 and 20, it is preferably applied centrally of that panel (i.e. at the location of the fold 17), because the panel 33 can be more readily detached from both panels 32 and 34 and the pouring spout be opened, by a pull at the centre of the panel 33. The fully opened spout 19 is shown in FIG. 21.

The version of FIGS. 14 to 21 has the advantage, over the version of FIGS. 12 and 13, that the sealing panel 34 is securely tacked-down to the obturating panel 22, rather than being partially tacked-down to facilitate running a thumb under the sealing fin to break the tacking; that the sealing panel 34 is wider overall, so providing better protection for the folded-down spout; and the whole of the pouring edge zone of the sealing panel 33 becomes available for pulling forward by the consumer.

What is claimed is:

1. A blank from which a carton is to be made, comprising a row of body panels comprised of first, second, third and fourth body panels with first lines of weakness thereamong, a row of top closure obturating panels comprised of first, second, third and fourth obturating panels with second lines of weakness thereamong and with third lines of weakness between the first, second, third and fourth obturating panels and the first, second, third and fourth body panels, respectively, and a row of top closure sealing panels comprised of first, second, third and fourth sealing panels with fourth lines of weakness thereamong and with fifth lines of weakness between the first, second, third and fourth sealing panels and the first, second, third and fourth obturating panels, respectively, sixth lines of weakness in the first obturating panel and the first sealing panel and seventh lines of weakness in the third obturating panel and the third sealing panel, whereby the first and third obturating panels may be folded to respective gable formations under the second and fourth obturating panels and whereby the first and third sealing panels may be centrally folded to between the second and fourth sealing panels to form a sealing fin and whereby the first obturating panel and the first sealing panel may be folded to form a pouring spout having as a pouring edge the free edge of said first sealing panel, a portion of that half of the first sealing panel nearer the second sealing panel projecting further from said row of obturating panels than does a portion of said second sealing panel, which two portions extend over equal distances relative to the boundary between the first and second sealing panels, wherein the improvement comprises the projecting portion of said first sealing panel extends along substantially half at least of the length of said free edge of said first sealing panel and over the middle of said free edge of said first sealing panel.

2. A blank according to claim 1, wherein said projecting portion extends along substantially the whole of said half of the first sealing panel.

3. A blank according to claim 2, wherein substantially the whole of that half of the first sealing panel nearer the fourth sealing panel projects from said row of obturating panels to substantially the same extent as said portion of that half of the first sealing panel nearer the second sealing panel.

4. A blank according to claim 1, wherein said fourth sealing panel projects from said row of obturating panels to an extent at least as great as does each of the first, second and third sealing panels.

5. A blank according to claim 4, wherein said fourth sealing panel projects from said row of obturating panels to an extent greater than does each of the first, second and third sealing panels and includes eighth lines of weakness extending substantially parallelly to said fifth lines of weakness and providing a tear strip.

6. A sealed carton comprising a loop of body panels comprised of first, second, third and fourth body panels, a loop of top closure obturating panels comprised of first, second, third and fourth obturating panels connected to the first, second, third and fourth body panels, respectively, and a loop of top closure sealing panels forming a sealing fin and comprised of first, second, third and fourth sealing panels connected to the first, second, third and fourth obturating panels, respectively, the first obturating panel and the first sealing panel serving to form a pouring spout when the carton is opened, a terminal outer edge zone of said first sealing panel projecting beyond an adjacent terminal outer edge zone of said second sealing panel, wherein the improvement comprises the projecting terminal outer edge zone of said first sealing panel extends along substantially half at least of the length of the terminal outer edge of said first sealing panel and over the middle of said terminal outer edge of said first sealing panel.

7. A carton according to claim 6, wherein said projecting terminal outer edge zone of said first sealing panel extends along substantially the whole of that half of said first sealing panel adjacent said second sealing panel.

8. A carton according to claim 7, wherein substantially the whole of that half of the first sealing panel nearer the fourth sealing panel projects from said loop of obturating panels to substantially the same extent as said portion of that half of the first sealing panel nearer the second sealing panel.

9. A carton according to claim 6, wherein said fourth sealing panel projects from said loop of obturating panels to an extent at least as great as does each of the first, second and third sealing panels and includes a part tacked to said second obturating panel.

10. A carton according to claim 9, wherein said fourth sealing panel projects from said loop of obturating panels to an extent greater than does each of the first, second and third sealing panels and includes a tear strip extending along said loop of sealing panels and outside said part tacked to said second obturating panel, said tear strip covering an inside pouring edge zone of said half of the first sealing panel nearer the fourth sealing panel.

* * * * *